United States Patent [19]

Grunert et al.

[11] Patent Number: 4,697,163

[45] Date of Patent: Sep. 29, 1987

[54] CIRCUIT BREAKER WITH IMPACT TRIP DELAY

[75] Inventors: Kurt A. Grunert, Beaver Boro; James R. Farley, Plum Borough, both of Pa.

[73] Assignee: Westinghouse Electric Corp., Pittsburgh, Pa.

[21] Appl. No.: 845,302

[22] Filed: Mar. 27, 1986

[51] Int. Cl.[4] ..... H01H 9/00

[52] U.S. Cl. ..... 335/174; 335/41; 335/63

[58] Field of Search ..... 335/41, 59, 63, 172, 335/173, 174, 239

[56] References Cited

U.S. PATENT DOCUMENTS

| | | | |
|---|---|---|---|
| 2,373,256 | 4/1945 | Miller | 335/239 |
| 4,001,742 | 1/1977 | Jencks et al. | 335/173 |
| 4,553,116 | 11/1985 | Bagalini | 335/173 |

*Primary Examiner*—E. A. Goldberg
*Assistant Examiner*—Lincoln Donovan
*Attorney, Agent, or Firm*—L. P. Johns

[57] ABSTRACT

A circuit breaker having a trip delay mechanism characterized by a variable magnetic air gap that is adjustable to permit time delay at low level overcurrents to avoid nuisance tripping during motor starting.

6 Claims, 6 Drawing Figures

CIRCUIT BREAKER WITH IMPACT TRIP DELAY

CROSS-REFERENCE TO RELATED APPLICATION

This application is related to copending application Ser. No. 875,914, filed June 19, 1986, entitled "Circuit Breaker With Trip Delay Magnetic Circuit", of K. A. Grunert and J. F. Changle; and Ser. No. 862,090, filed May 12, 1986, entitled "Circuit Breaker with Visible Trip Indicator", of W. W. Lang, W. E. Beatty and J. A. Wafer.

BACKGROUND OF THE INVENTION

1. Field of the Invention

This invention relates to a circuit breaker within an insulating housing, and more particularly, it pertains to a magnetic circuit mechanism for allowing an over-ride time delay to avoid premature tripping of the circuit breaker.

2. Description of the Prior Art

Typical magnetic trip mechanisms are designed with a magnetic solenoid applying a force to a trip bar that releases a latch. This type of device operates at a particular current value (translated into force via a magnetic field generated by the current) immediately when the magnitude of the current is reached. Thus, if the current only momentarily rises to a trip value, then reduces to a lower level (a normal and safe level), the conventional construction will still cause a tripping and current interruption to take place and thereby cause nuisance tripping of the circuit interrupter.

SUMMARY OF THE INVENTION

In accordance with this invention, a circuit breaker is provided which comprises an insulating housing containing a circuit breaker mechanism having a pair of separable contacts including a movable contact, a movable contact arm carrying the movable contact and movable between/ open and closed positions of the contacts, a movable mechanism for actuating the contact arm and comprising a pivotally supported releasable member, latching means for latching the releasable member and including a latch lever movable between latched and unlatched positions of the releasable member, trip means including a trip bar for releasably holding the latch lever in the latched position, trip delay means for avoiding premature unlatching of the trip bar and including a body movable against the trip bar and biased away therefrom, an electromagnetic device responsive to a predetermined overcurrent condition and including a solenoid coil and a plunger for moving the body against the trip bar to an unlatched position thereof, the plunger being slidably mounted on the body for movement of the body against the trip bar to thereby move the trip bar to the unlatched position of the latch lever, a delay spring between the plunger and the body for controlling movement of the plunger against the body by a force of the magnetic flux incurred by the solenoid coil as overcurrent conditions approach the predetermined overload conditions, and adjustable means for holding the body in a retracted position from the trip bar under normal current operating conditions.

The advantage of this device is that it permits an over-ride time delay of a current pulse during motor starting which would otherwise cause nuisance tripping of the circuit interrupter.

DESCRIPTION OF THE PREFERRED EMBODIMENT

Figure 1:
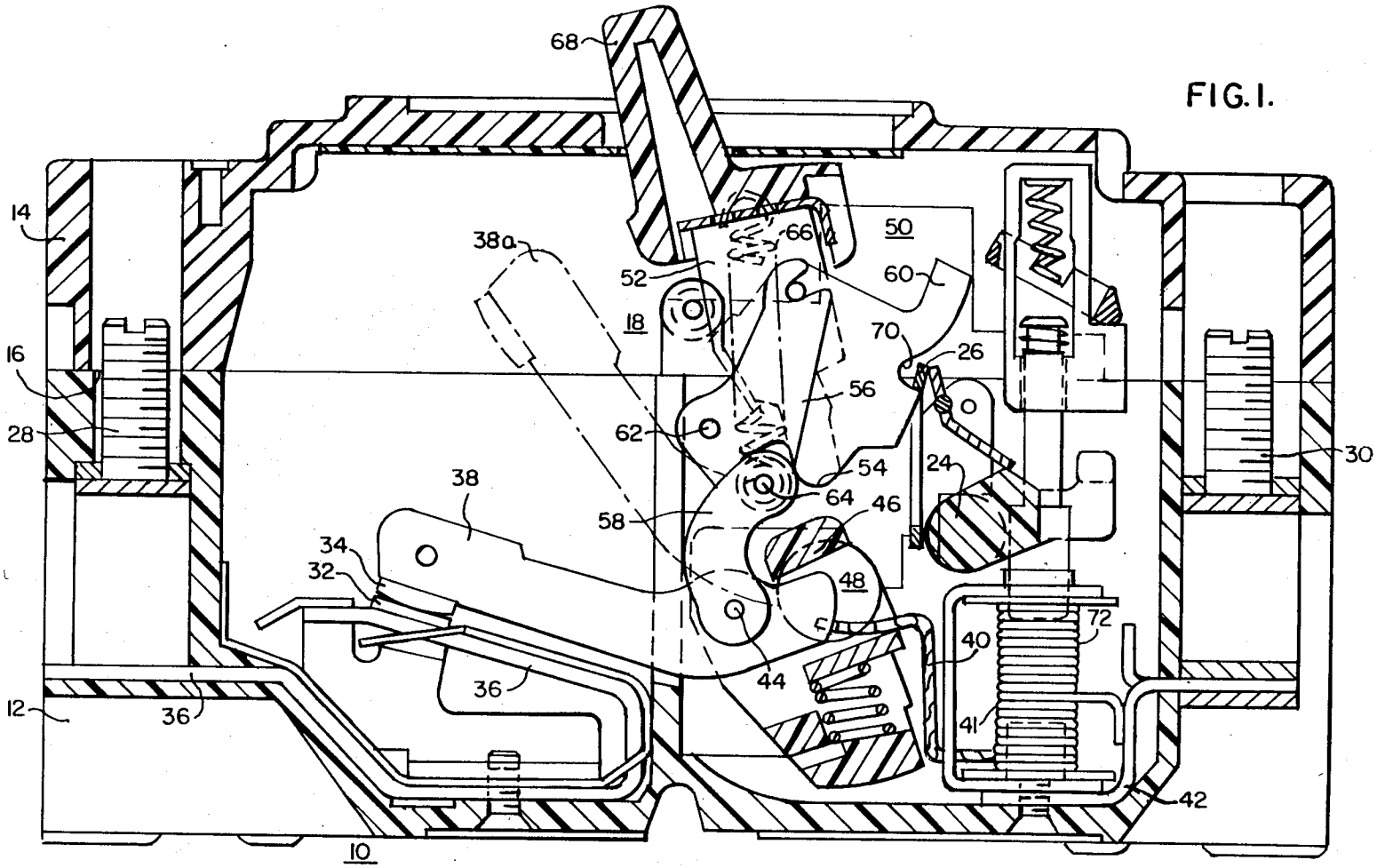
FIG. 1 is a vertical sectional view through the center pole of a multi-pole circuit breaker showing an impact trip delay mechanism.

In FIG. 1, a molded case circuit breaker is generally indicated at 10 and it comprises an insulating housing or base 12 having a cover 14 which is mechanically attached at a parting line 16 where the cover is retained in place by a plurality of fasteners (not shown). The circuit breaker may be of a single or multiple pole construction. The latter construction comprises insulating barriers separating the interior of the housing into adjacent side-by-side pole unit compartments in a well known manner. For the multiple pole unit, such as a three-pole circuit breaker, an operating mechanism 18 is disposed in a center pole unit. However, each pole includes a separate trip delay device 22 for rotating a trip bar 24 which in turn releases a latch lever 26.

For a polyphase circuit breaker, a pair of similar terminals including line terminal 28 and load terminal 30, at opposite ends of the housing 10, are provided for each phase. Terminals 28, 30 are employed to serially electrically connect the circuit breaker 10 into an electrical circuit such as a three-phase circuit, to protect the electrical system involved.

The circuit breaker 10 is shown (FIG. 1) in the closed position with a pair of separable contacts including a fixed contact 32 and a movable contact 34 in electrical contact with each other. In that position, a circuit through a circuit breaker extends from the line terminal 28 through a conductor 36, contacts 32, 34, a contact arm 38, a shunt 40, a coil 41 in the trip delay device 22, and a conductor 42 to the load terminal 30.

The contact arm 38 is pivotally connected at a pivot pin 44 to a rotatable carriage 46, which is secured to or integral with a cross bar 48. The contact arm 38 and the carriage 46 rotate as a unit with the cross bar 48 during normal current conditions through the circuit breaker 10. The operating mechanism 18 is typical of that set forth in U.S. Pat. No. 4,503,408 for which reason it is not described herein in detail. Suffice it to say, the mechanism 18 is positioned between spaced support plates 50 (one of which is shown) which are fixedly secured to base 12 of the center pole unit. An inverted U-shaped operating lever 52 is pivotally supported in U-shaped notches 54 on the plates with the ends of the legs of the lever supported in the notches of the plates.

Operating mechanism 18 includes an over-center toggle having an upper toggle link 56 and a lower toggle link 58 which connect the contact arm 38 to a releasable cradle member 60 that is pivotally supported on the plates 50 by a pin 62. The toggle links 58, 60 are pivotally connected by means of a knee pivot pin 64. Over-center operating springs 66 are connected under tension between the knee pivot pin 64 and the bight portion of the lever 52. A handle 68 is mounted on the upper end of the lever 52 for manual operation of the operating mechanism 18.

Contacts 32, 34 are normally manually separated by movement of the handle 68 in the leftward direction from the position shown in FIG. 1 from the ON to the OFF position. However, inasmuch as the latch lever 26 of the trip delay device 22 engages a notch 70 of the cradle member 60, the circuit breaker 10 is in the untripped position as shown in FIG. 1. For the purpose of this invention, the circuit breaker operating mechanism 18 is shown as being tripped solely by the trip device 22. Other means for tripping, such as separate high-speed electromagnetic trip devices, are described elsewhere such as in U.S. Pat. No. 4,220,935.

in accordance with this invention, when the operating mechanism 18 is tripped, by whatever means, such as the trip device 22, the contact arm 38 moves to the broken line position 38*a*. The magnetic device of this invention permits a delay of the trip function, at low level overcurrents, such that motor starting transient currents will not permanently trip the circuit breaker. The trip delay magnetic device 22 delays the mechanical motion after the application of an electrical impulse. For that purpose, the trip delay magnetic device 22 (FIG. 2) includes an electromagnetic solenoid including a coil 72 wrapped within a bobbin 74, which in turn is mounted within spaced frame members 76, 77 and a bight portion 78. A solenoid plunger 80 is movable vertically in and out of the coil 72 and it includes an integral shaft 82 which extends through and is slidable in a hole 84 in a body 86. The body 86 includes a window 88 in which a coil spring 90 is seated which spring is disposed around the upper end portion of the shaft 80 and between a button 92 and a lower surface 94 of the window 88. The button 92 is fixedly mounted on the upper end of the shaft 82. By this construction, the plunger 80 is held in the withdrawn position (FIG. 2) under normal current operating conditions.

Under normal operating conditions, current flows through the coil 72 and generates an electromagnetic force which attracts the plunger 80 downwardly into the coil by a distance proportional to the force and opposed by the coil spring 90 acting against the button 92. When slight overcurrents occur of a value less than that of a predetermined magnitude for tripping the circuit breaker, any resulting increases in the electromagnetic force applied by the coil upon the plunger 80 are resisted and absorbed by the coil spring 90 up to the force corresponding to the predetermined magnitude established for tripping.

However, when an overcurrent of a predetermined magnitude occurs, and electromagnetic force of sufficient value pulls the plunger 80 downwardly against the spring 90 causing the button 92 to strike a lower surface 94, whereby an enlarged portion or hammer 96 of the body 86 strikes an arm 98 of the trip bar 24. The trip bar is thereby rotated clockwise to enable a lever 100 pivoted at 102 to ride off a surface 104 of the arm, causing the lever 100 to rotate clockwise. As a result, the latch lever 26 is forced off of its latched position on the surface 70 of the cradle member 60, causing the cradle to rotate counterclockwise or upwardly and to trip the circuit breaker. Thus, the spring 90 suppresses transient overcurrents to prevent nuisance tripping of the circuit breaker.

A coil spring 106 is disposed within the window 88 of the body 86 and extends between an upper surface 108 of the window and an adjustment bar 110 for adjusting for the desired pressure on the coil spring 90. The lever 110 is pivotally mounted and may be moved for adjustment in a suitable manner known in the art such as by a cam (not shown).

Figure 3:
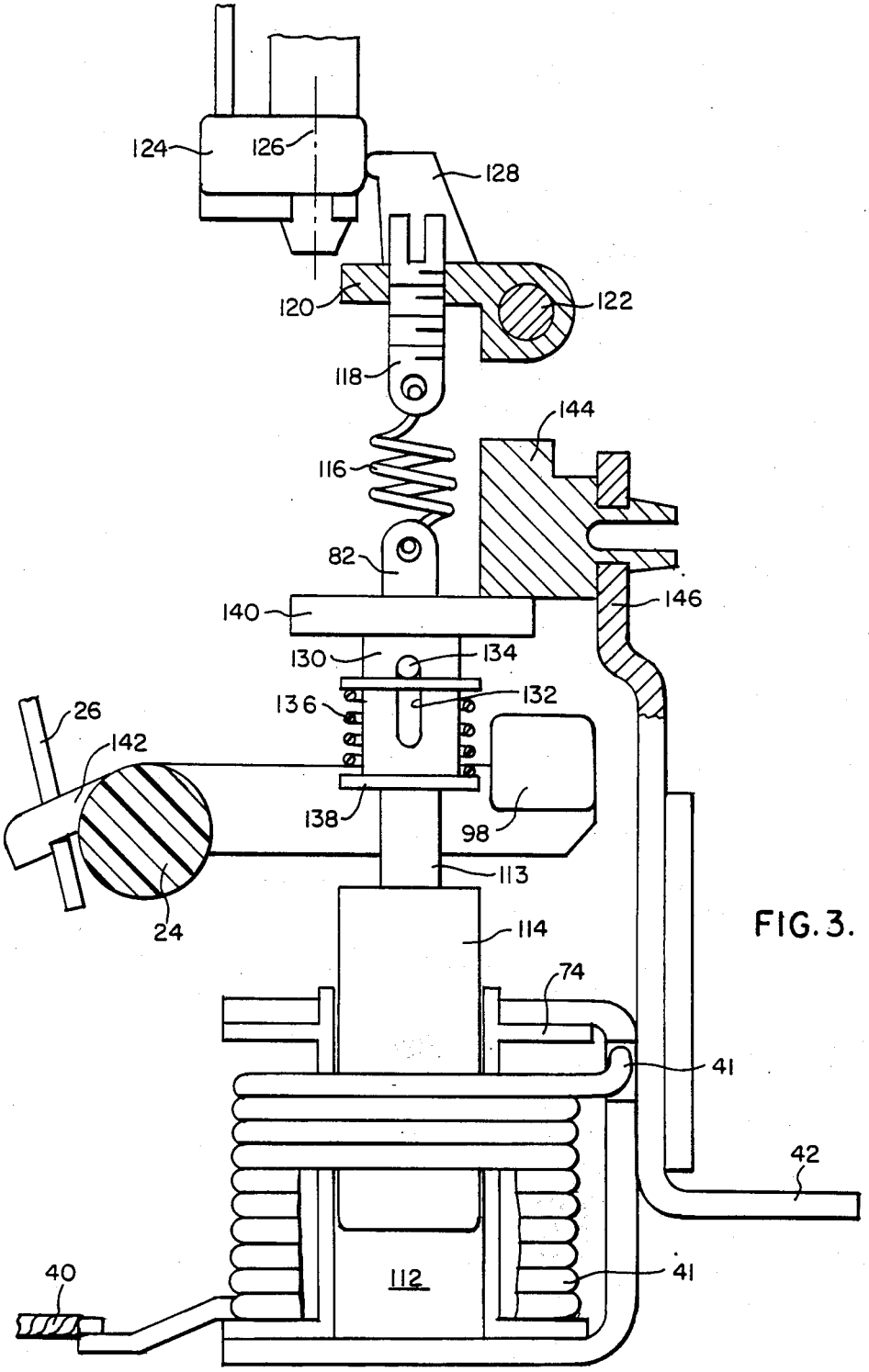
FIG. 3 is an enlarged, vertical sectional view of a trip delay mechanism of another embodiment.

Another embodiment of the invention is a trip delay device 112 (FIG. 3) in which similar numerals refer to similar parts. The device 112 comprises a solenoid or plunger 114 having a shaft 113. The upper end of the shaft is suspended from a coil spring 116 which in turn is suspended from an adjustment screw 118 which is threadedly mounted on an adjustment bar 120 that is pivotally mounted by pin 122. The adjustment screw 118 controls tension in the coil spring 116 and therefore the force by which the plunger 114 is suspended therefrom. The force may be increased or decreased by rotation of a cam 124 rotatable on an axis 126 which cam operates on a cam follower 128 of the adjustment bar 120. The adjustment screw 118 is internal of the housing and sets tripping for high currents and is normally set by the manufacturer. The cam 124 is normally adjusted by the user to set a trip current to all three poles simultaneously.

Figure 2:
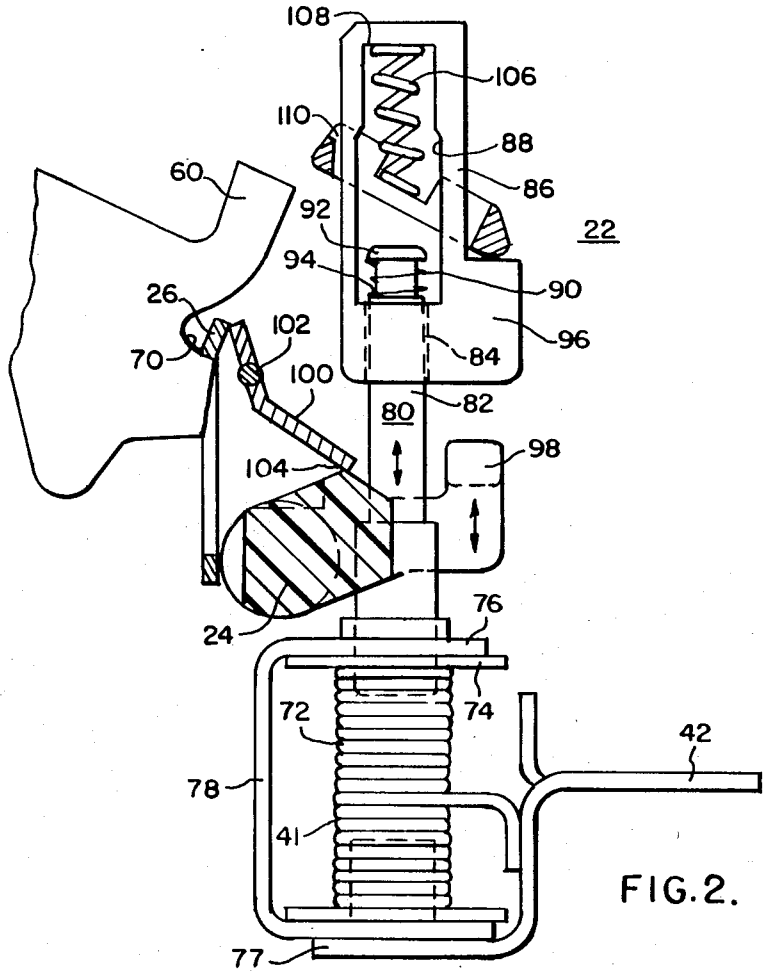
FIG. 2 is an enlarged elevational view, partly in section, of the trip delay mechanism as used in the circuit breaker in FIG. 1.

A sleeve 130 having opposed slots 132 on opposite sides is slidably mounted on the shaft 113 and movable vertically with respect to a retainer pin 134 extending through the shaft. A coil or control spring 136 is mounted around the sleeve with the upper end against the pin 134 and the lower end seated on a flange 138 of the sleeve. The sleeve 130 also includes an upper flange or hammer 140 for striking the arm 94 when the plunger 114 is drawn fully into the coil 114 in response to a predetermined overcurrent condition. In such case, the trip bar 24 rotates counterclockwise to raise a latch 142 out of latching engagement with the latch lever 26 which in turn rotates counterclockwise to release a cradle member 60, such as shown in FIG. 2.

In a manner similar to that set forth in regard to the trip delay device 22 (FIG. 2), interplay between the magnetic field generated by the coil 41 on the plunger 114, the force of the control spring 136, and the force of the high trip spring 116 exists. Adjustments between the pressures and forces incurred between these elements is further adjustable by a high trip cam 144 which acts upon the top surface of the hammer 140 and which is rotatably mounted in an aperture end member 146. The high trip cam 144 on internally adjustable means to calibrate the basic trip position of the hammer-plunger assembly. This is done to each pole separately to adjust all trip values equal between poles, or as desired pole-to-pole. Like the trip delay device 22 (FIG. 2), the trip delay device 112 (FIG. 3) is operated by the magnetic field generated by the coil 41 which pulls the plunger 114 against the control spring 136 through the retainer pin 134 to allow a time delay and impact to build up in response to increase in the kinetic energy of the assembly of the coil 140 and solenoid or plunger 114.

Figure 4:
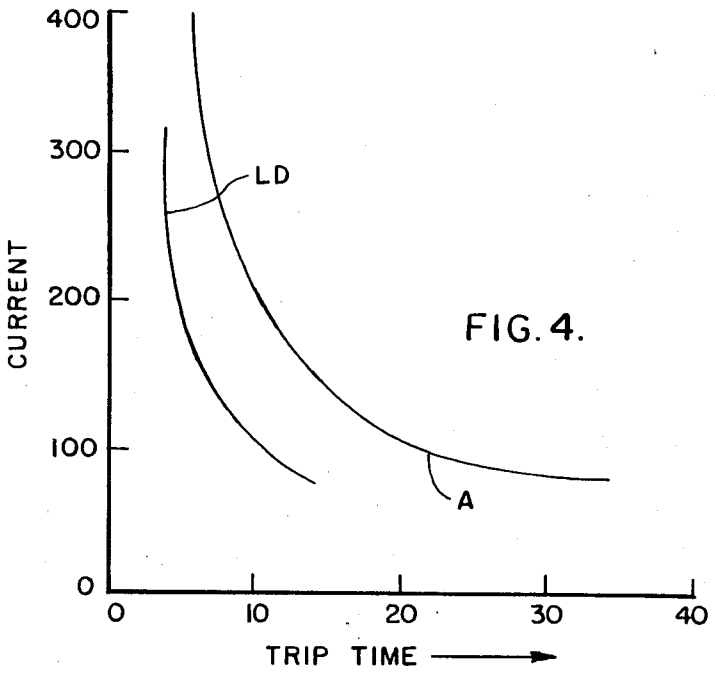
FIG. 4 is a graph of current versus trip time showing maximum and minimum impact curves.

When the plunger moves the pin 134 to the bottom of the slot 132, any further downward movement of the plunger causes the hammer 140 to move toward the arm 98. With the current or magnetic field maintained long enough, the hammer strikes the trip bar or arm 98 and releases the latch lever 26. The relationship between the trip time and current when the retainer pin 134 is located at the upper position, the trip time is indicated by the upper or maximum impact curve shown in FIG. 4.

On the other hand, when the pin is located in the "LD" position, at the same current value, the trip time is shown in the lower or minimum curve. Any intermediate trip time between the lower ends of the maximum impact and minimum impact curves is indicated for example by an intermediate time A.

Figure 5:
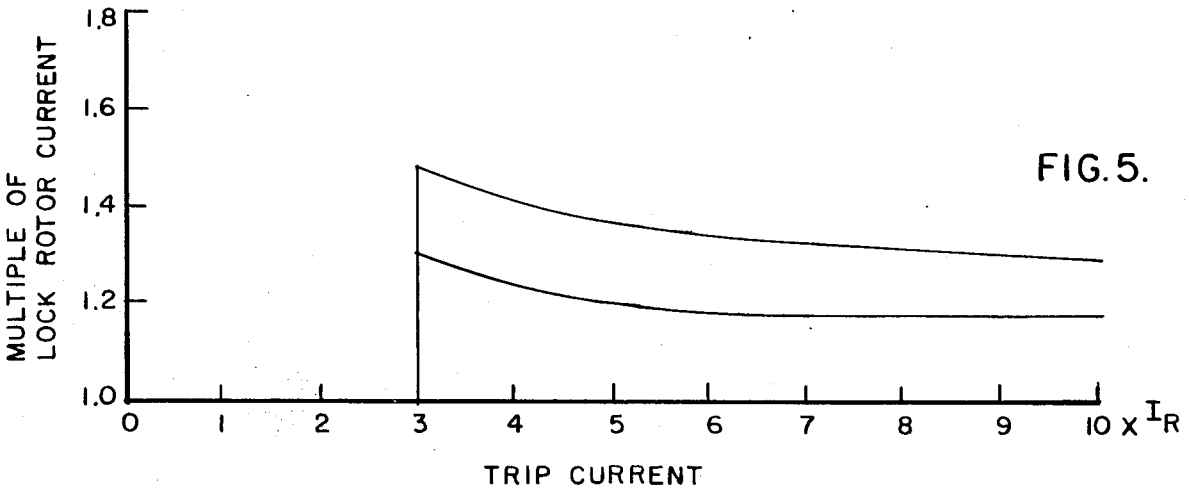
FIG. 5 is a graph of transient current multiplier versus trip current, showing the transient filter effect.

A transient filter effect is shown in FIG. 5 in which the effect of the delay spring 136 in overriding the inrush pulse is compared to having no delay spring at all. Thus, at trip current 3, the override band of the inrush is 1.3 to 1.44 times the starting current value.

Figure 6:
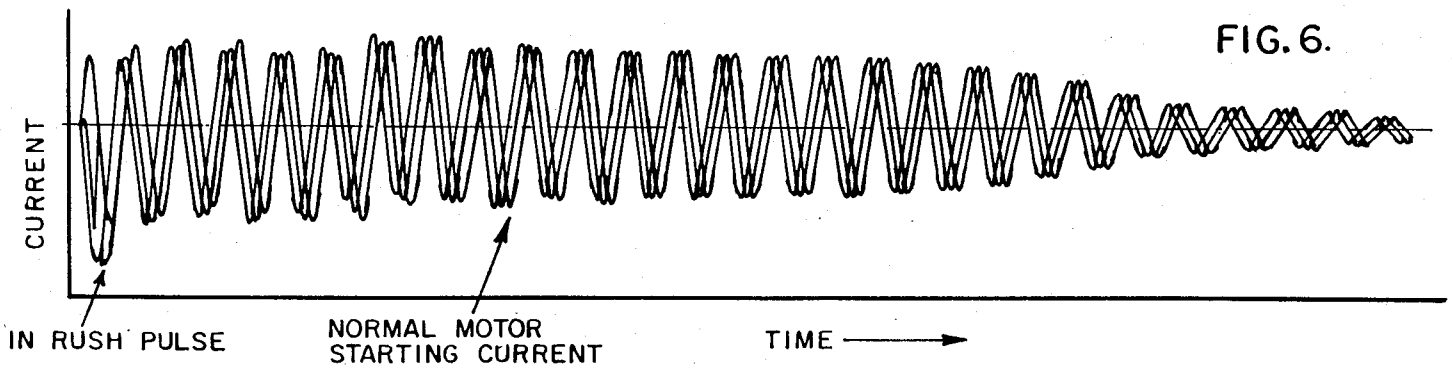
FIG. 6 is a graph of current versus time, showing the motor starting in-rush pulse.

For motor starting currents, wherein a transient pulse current at the instant of the motor start up (FIG. 6) could cause circuit breaker tripping for which an impact delay is provided by the trip delay devices 22, 112. The motor can then accelerate without interruption, even though the first current pulse would trip a standard magnetic sensitive breaker trip mechanism. Thus, the starting inrush pulse B (FIG. 6) is higher magnitudewise than the starting current. Overload relays are set to trip at the starting currents, with motor control protectors taking over at just above the starting current level. Therefore, the inrush pulse would trip the breaker. The spring 136 allows no override of travel of the plunger 114 to delay tripping long enough so the inrush pulse passes.

With an emphasis on a high-efficiency motor design, inductance values (especailly evident in motor starting) have been demonstrated to cause high valued nuisance current pulses. While not affecting motor operation, frequently motor start ups cannot occur at the proper breaker tripping setting. The device of this invention enables normal motor start up with no change in effective circuit protection capability.

Accordingly, in accordance with this invention, the trip delay device provides for a delay between the inrush pulse current and the starting current and thereby avoids nuisance tripping of the circuit breaker.

What is claimed is:

1. A circuit breaker comprising:

a pair of separable contacts including a movable contact;

a movable contact arm carrying the movable contact and movable between open and closed positions of the contacts;

an operable mechanism for actuating the contact arm and comprising a pivotally supported releasable member;

latching means for latching the releasable member and including a latch lever movable between latched and unlatched positions of the releasable member;

trip means including a trip bar for releasably holding the latch lever in the latched position;

trip delay means for avoiding premature unlatching of the trip bar and including a body movable against the trip bar and biased away therefrom;

an electromagnetic device responsive to a predetermined overcurrent condition and including a solenoid coil and a plunger for moving the body against the trip bar to an unlatched position thereof;

the plunger being slidably mounted on the body for movement of the body against the trip bar to thereby move the trip bar to the unlatched position of the latch lever; and a delay spring between the plunger and the body for controlling movement of the plunger against the body by a force of the magnetic flux incurred by the solenoid coil as overcurrent conditions approach the predetermined overload conditions.

2. The circuit breaker of claim 1 in which the plunger and the body comprise spaced facing surfaces between which the spring is supported.

3. The circuit breaker of claim 2 in which the plunger includes a transverse surface and the body having lateral surface means engageable by the transverse surface of the plunger to cause unlatching of the trip bar.

4. The circuit breaker of claim 3 in which adjustable means are provided for holding the body in a retracted position from the trip bar under normal current operating conditions.

5. The circuit breaker of claim 4 in which the body includes an opening into which the plunger extends and in which the spring is disposed around the plunger.

6. The circuit breaker of claim 4 in which the transverse surface of the plunger is aligned with a strike surface of the trip bar.

* * * * *